US010946232B2

(12) United States Patent
Bion

(10) Patent No.: US 10,946,232 B2
(45) Date of Patent: Mar. 16, 2021

(54) DOORWAY SQUAT AND CALVES WORKOUT SYSTEM

(71) Applicant: Anton Bion, Cupertino, CA (US)

(72) Inventor: Anton Bion, Cupertino, CA (US)

( * ) Notice: Subject to any disclaimer, the term of this patent is extended or adjusted under 35 U.S.C. 154(b) by 0 days.

(21) Appl. No.: 16/207,268

(22) Filed: Dec. 3, 2018

(65) Prior Publication Data

US 2019/0168061 A1 Jun. 6, 2019

Related U.S. Application Data

(60) Provisional application No. 62/594,453, filed on Dec. 4, 2017.

(51) Int. Cl.

| | |
|---|---|
| ***A63B 21/16*** | (2006.01) |
| ***A63B 23/04*** | (2006.01) |
| ***A63B 21/00*** | (2006.01) |
| ***A63B 21/055*** | (2006.01) |
| ***A63B 21/02*** | (2006.01) |

(52) U.S. Cl.

CPC .... *A63B 21/1636* (2013.01); *A63B 21/00181* (2013.01); *A63B 21/023* (2013.01); *A63B 21/0552* (2013.01); *A63B 21/4005* (2015.10); *A63B 21/4039* (2015.10); *A63B 23/0405* (2013.01); *A63B 21/025* (2013.01); *A63B 2208/0223* (2013.01)

(58) Field of Classification Search

CPC ..... A63B 21/0407; A63B 21/0428; A63B 21/4039; A63B 21/05; A63B 21/1636; A63B 2023/0411

See application file for complete search history.

(56) References Cited

U.S. PATENT DOCUMENTS

| | | | | | |
|---|---|---|---|---|---|
| 4,239,212 | A * | 12/1980 | Hickey | A63B 21/00043 | 482/126 |
| 4,865,317 | A * | 9/1989 | Hickey | A63B 21/05 | 482/126 |
| 5,462,508 | A * | 10/1995 | Schiavone | A63B 21/055 | 482/122 |
| 5,624,360 | A * | 4/1997 | Wilkins | A63B 21/1645 | 482/121 |
| 5,954,622 | A * | 9/1999 | Olschansky | A63B 21/4015 | 482/123 |
| 6,712,742 | B2 * | 3/2004 | Suiter | A63B 21/0004 | 482/140 |
| 7,578,773 | B2 * | 8/2009 | Gronda | A63B 21/00069 | 482/111 |
| 2007/0287617 | A1 * | 12/2007 | Teng | A63B 21/0087 | 482/126 |

* cited by examiner

*Primary Examiner* — Joshua T Kennedy

(74) *Attorney, Agent, or Firm* — Law Office of Ilya Libenzon

(57) ABSTRACT

The system of the present invention includes elastic bands that are affixed and inserted within elastic band insertion slots that are disposed on a u-shaped frame and a rectangular-shaped frame. The squatting motion the user performs on the present invention activates the expansion and retraction of the elastic bands, which exerts resisting force upon the user, simulating weights.

18 Claims, 9 Drawing Sheets

DOORWAY SQUAT AND CALVES WORKOUT SYSTEM

TECHNICAL FIELD

Embodiments disclosed herein relate generally to a lower body workout apparatus, and in particular to a doorway squat and calf workout apparatus.

BACKGROUND ART

Lower body workout apparatuses are designed to apply an amount of restrictive force upon the motion of a user's lower body muscles, when exercising the lower body. Said apparatuses target one or more muscles within the lower body. Examples of lower body workouts would be squats, where a user is at a full standing position and simply squats down keeping the thighs parallel or nearly parallel to the ground, then returns to the full standing position.

A related product that is currently available on the market today is the doorway pull-up/chin-up bar apparatus. With said apparatus, the user affixes it onto the top of a doorway frame; the design of it enables it to lock on the top of the doorway, providing a hanging bar for the user to perform a pull-up/chin-up exercise. The relation of this apparatus to the device of the presented invention is that both apparatuses are affixed onto the top of a doorway frame.

Another related product is a squat rack device. The squat rack device consists of a square or rectangular shaped frame with protruding prongs that are meant to hold a bench-press barbell at specific heights. The squat rack allows the user to position the bench-press barbell at a height that is slightly lower than their shoulder level height by resting the said bench-press barbell on the said protruding prongs. The user sets the bench-press barbell to its desired height, which is typically slightly lower than the height of its shoulders. The user then loads the bench-press barbell with a desired amount of weight plates. The user then positions his or her shoulders under the said bench-press barbell. The user proceeds to stand at full height, lifting the bench-press barbell off of the protruding prongs of the squat rack device. The user proceeds with the workout by taking a step away, typically forward, positioning the bar-bell out from under the protruding prongs then proceeds to perform the squat exercise, squatting down and up while the weight loaded bench-press barbell is resting on the user's shoulders. The relation of this said squat rack device to the present invention is that both of them apply a weight/resistance upon the user's shoulders as the user performs squats. However, the described-above prior art systems are bulky, expensive, inconvenient, difficult to set up and operate.

Therefore, there is a need for a doorway squat and calf workout system that is compact, inexpensive, convenient, easy to set up and operate and most importantly just as effective and efficient in developing lower body muscles.

SUMMARY OF THE EMBODIMENTS

The present invention is an apparatus that latches and hangs upon the top of an interior doorframe. The user positions himself/herself under the hanging device of the present invention, aligning each of the user's shoulders under each of the shoulder harnesses. The user then performs a squat exercise, exactly as the user would on an existing squat rack, with the exception of not having to load weight or take a step away from the squat rack. The system of the present invention includes elastic bands that are affixed and inserted within elastic band insertion slots that are disposed on a u-shaped frame and a rectangular-shaped frame. The squatting motion the user performs on the present invention activates the expansion and retraction of the elastic bands, which exerts resisting force upon the user, simulating weights.

Other aspects, embodiments and features of the device and method will become apparent from the following detailed description when considered in conjunction with the accompanying figures. The accompanying figures are for schematic purposes and are not intended to be drawn to scale. In the figures, each identical or substantially similar component that is illustrated in various figures is represented by a single numeral or notation. For purposes of clarity, not every component is labeled in every figure. Nor is every component of each embodiment of the device and method shown where illustration is not necessary to allow those of ordinary skill in the art to understand the device and method.

BRIEF DESCRIPTION OF THE DRAWINGS

The preceding summary, as well as the following detailed description of the disclosed system and method, will be better understood when read in conjunction with the attached drawings. It should be understood, however, that neither the device nor the method is limited to the precise arrangements and instrumentalities shown.

DETAILED DESCRIPTION OF SPECIFIC EMBODIMENTS

Part Reference Numbers.

Figure 1:
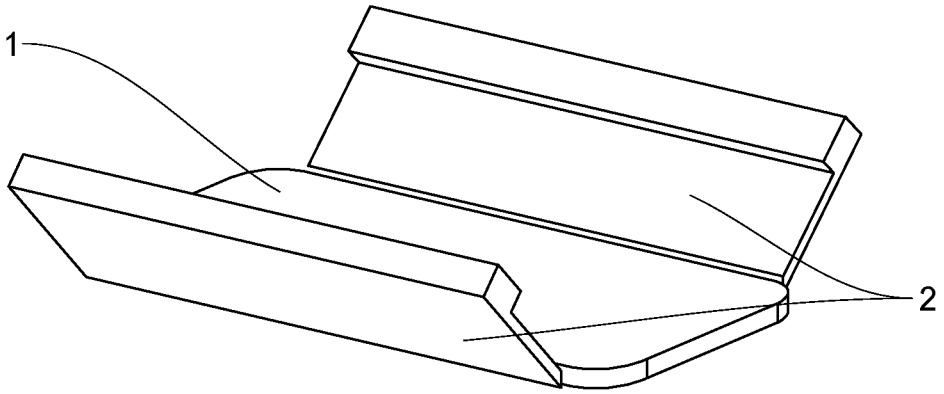
FIG. 1 is a perspective view of the doorway frame clamp assembly. This assembly includes two doorframe clamp arms that are hinged on a doorframe base.
Figure 2:
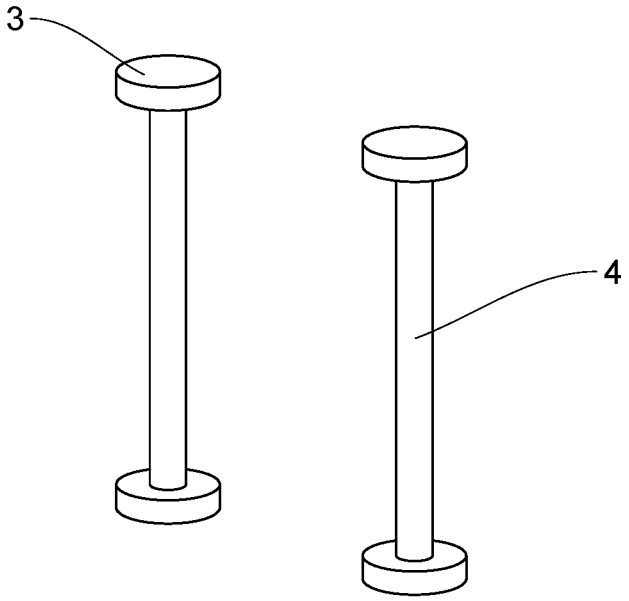
FIG. 2 is a perspective view of two elastic band assemblies that include elastic bands and elastic band end caps.
Figure 3:
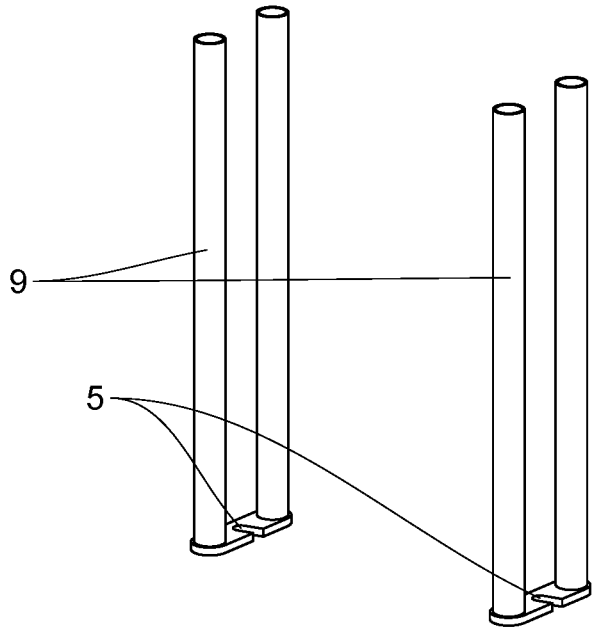
FIG. 3 is a perspective view of a u-shaped frame, which includes the u-shaped frame component and elastic band insertion slots.
Figure 4:
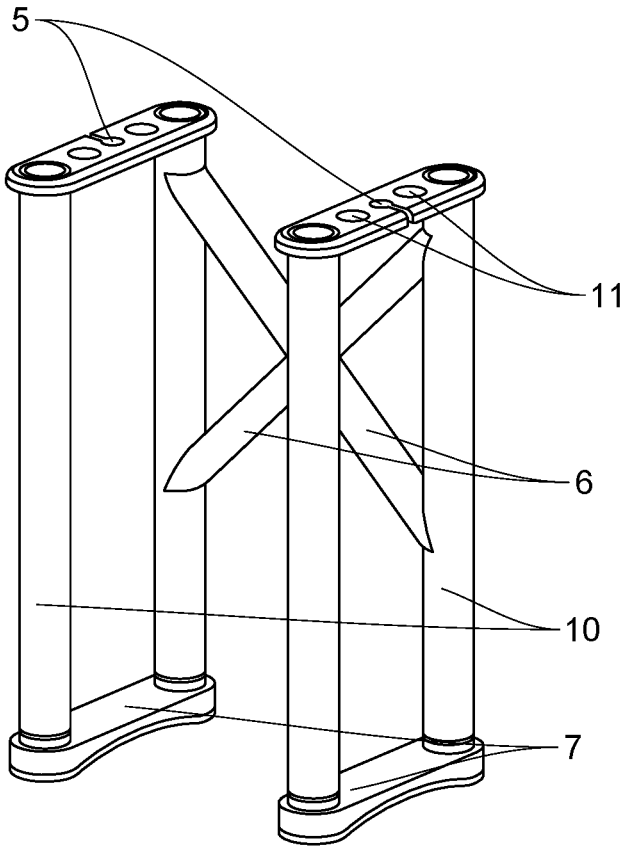
FIG. 4 is a perspective view of a rectangular-shaped frame, which includes the rectangular-shaped frame as well as frame stabilization bars.
Figure 5:
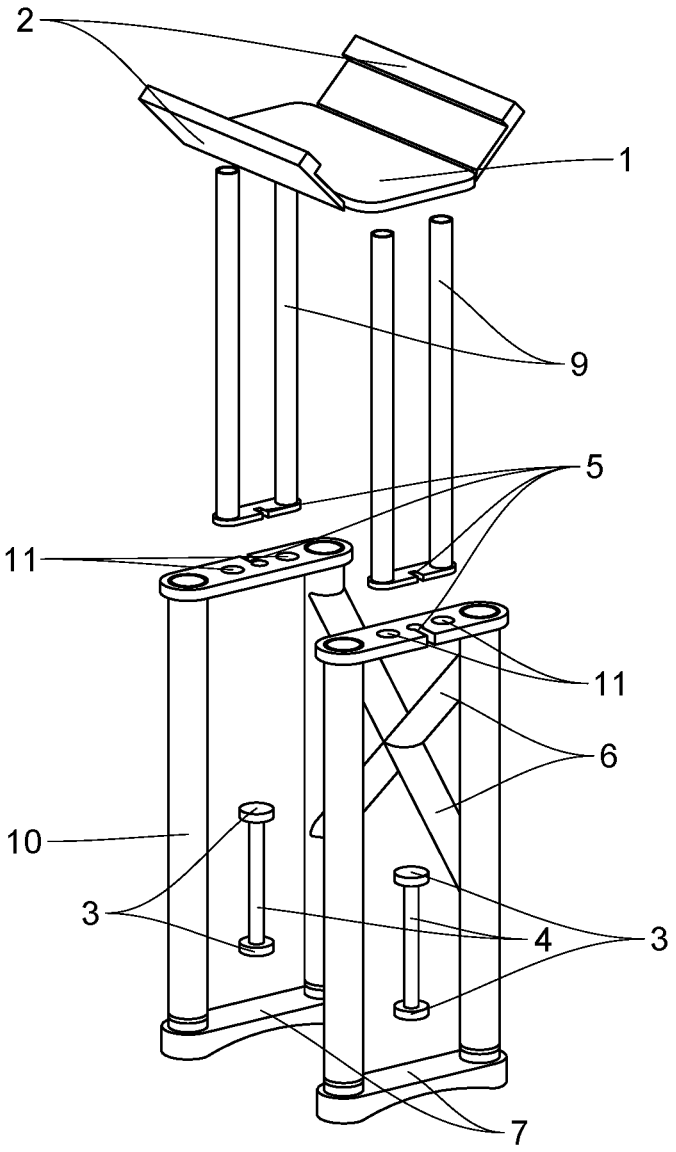
FIG. 5 is an exploded, isometric view of the entire system of the present invention, including all the components shown in FIGS. 1-5.

1—Doorframe Base
2—Doorframe Clamp Arm
3—Elastic Band End Cap
4—Elastic Band
5—Elastic Band Insertion Slot
6—Frame Stabilization Bar
7—Shoulder Harnesses
8—Motion Alignment Stabilizer
9—U-Shaped Frame
10—Rectangular-Shaped Frame
11—U-Shaped Frame Insertion Slot
12—C-Shaped Frame Referring to FIGS. 1-6 in more detail, the exercise apparatus of the present invention includes two rectangular-shaped frames 10 each having one elastic band insertion slot 5 and two u-shaped frame insertion openings 11 for slidably receiving two u-shaped frames 9 each having one elastic band insertion slot 5, as shown in FIG. 3, two elastic bands 4, for insertion into the elastic band insertion slots 5, each having elastic band end cap 3, as shown in FIG. 2, a pair of shoulder harnesses 7, as illustrated in FIG. 4, one or more frame stabilization bars 6 coupled to the rectangular-shaped frames 10, and, coupled to the u-shaped frames 9, doorway base 1 having two doorway clamp arms 2, as shown in FIG. 1. It will be appreciated by a person skilled in the art that the base 1 can be permanently attached to the u-shaped frames 9 using glue or any other suitable attaching means. It can form an integrally one piece by injection molding. In some instances, the base 1 can be detachably coupled to the u-shaped frames 9 by insertion through the slots or openings and capped at the top, similar to the caps 3 of the elastic bands 4 shown in FIG. 2, for example. In some instances, springs of various resistance characteristics (not shown) can be used instead of elastic bands. In some instances, doorway base 1 does not include the doorway clamp arms. The doorway base can be rectangular in shape. It can also be tubular in shape. It can be of any other shape suitable for attaching the base to the top of the doorframe. It will be appreciated by a person skilled in the art that the base can be attached to the doorframe with various attaching means such as nails, bolts, screws, hooks and loops, mounting brackets and the like. In some instances, the base can be tubular and telescopic, configured to extend laterally and be locked between the sides of the doorframe. In some instances the base can be shape and configured to attach to the doorframe the same way as commercially available pull-up bars. In some instances the base can include a plurality of holes for attaching the base to the doorframe by inserting the bolts or screws through the holes.

Figure 6:
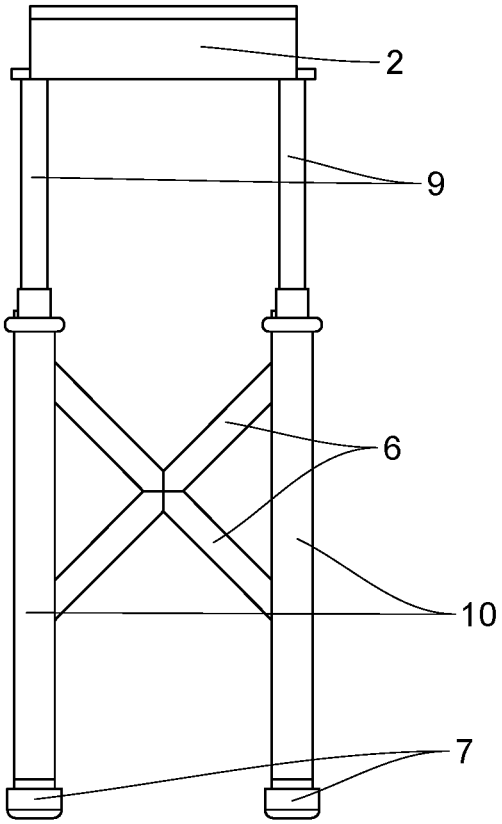
FIG. 6 is a frontal view of the entire present invention, assembled, at its expanded position.
Figure 7:
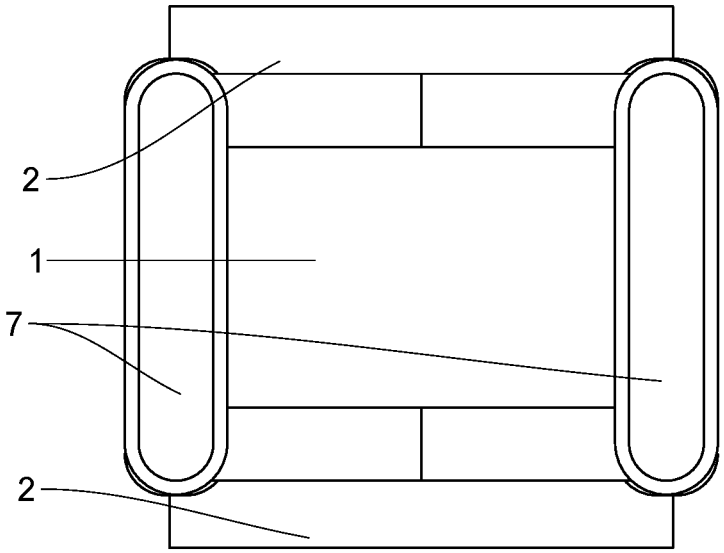
FIG. 7 is a bottom view of the entire system of the present invention, in the assembled state.
Figure 8:
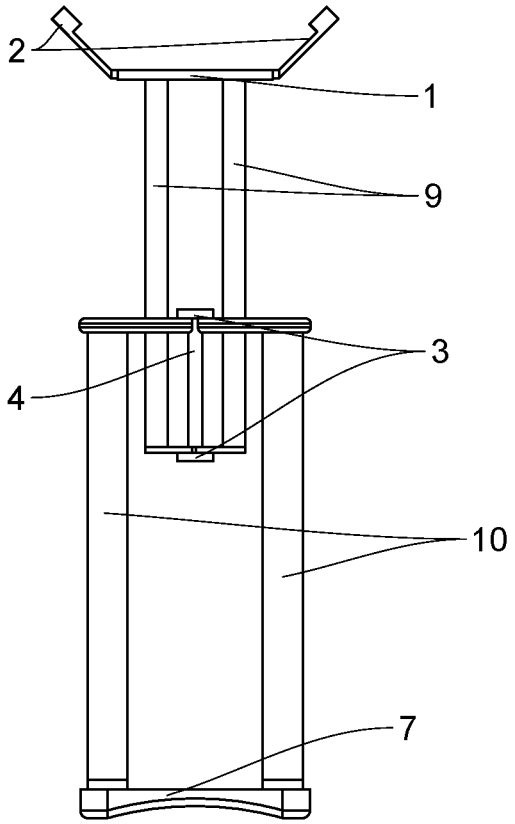
FIG. 8 is a side view of the entire system of the present invention, assembled, at its expanded position.
Figure 9:
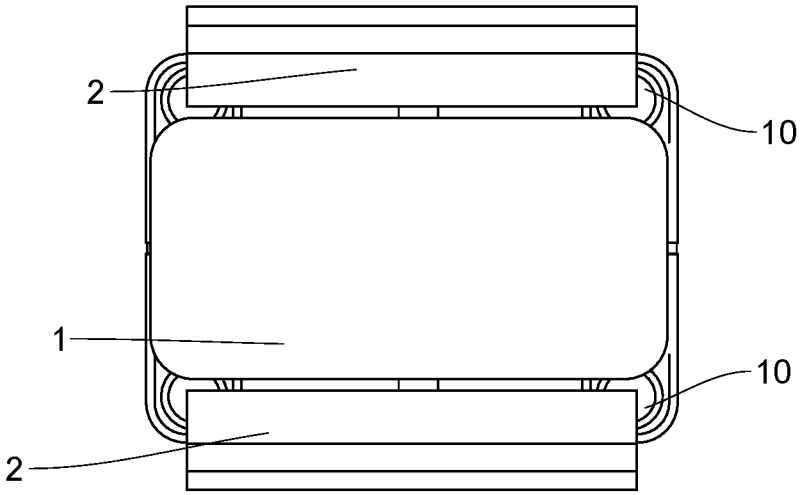
FIG. 9 is a top view of the entire present invention, assembled.

The rectangular-shaped frames 10 have a slightly larger width, when viewing it from the present inventions side, versus the u-shaped frames 9, as illustrated in FIG. 6. The rectangular-shaped frames 10 have u-shaped frame insertion slots 11 as to allow the vertical bars of the u-shaped frame 9 to insert and glide through the said u-shaped frame insertion slots 11.

Figure 11:
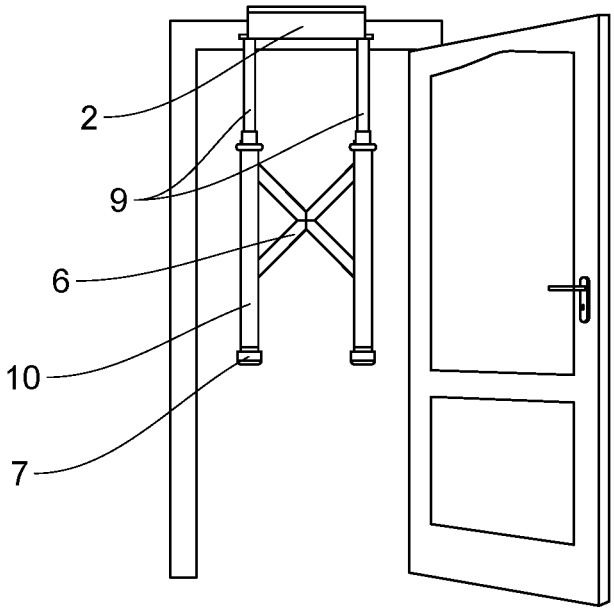
FIG. 11 is a frontal view of the entire system of the present invention, assembled and expanded, hinged on a doorframe.

The doorframe base clamp assembly, comprising the doorframe base 1 and the doorframe clamp arms 2 is designed and shaped to clamp onto the top of any interior doorframe and allow the remaining present invention to hang securely from the top of an interior doorframe, as shown in FIG. 11. The u-shaped frames 9 are mounted onto the said doorframe base clamp assembly, wherein the rectangular-shaped frames 10 are positioned under the u-shaped frames 9, with the u-shaped frame 9 vertical bars being inserted into the u-shaped frame insertion slots 11, thereby essentially affixing the u-shaped frames 9 and rectangular-shaped frames 10 together, slidably interlocking one another. The frames 9 and 10 have elastic band insertion slots 5, for inserting the elastic bands 4.

Figure 10:
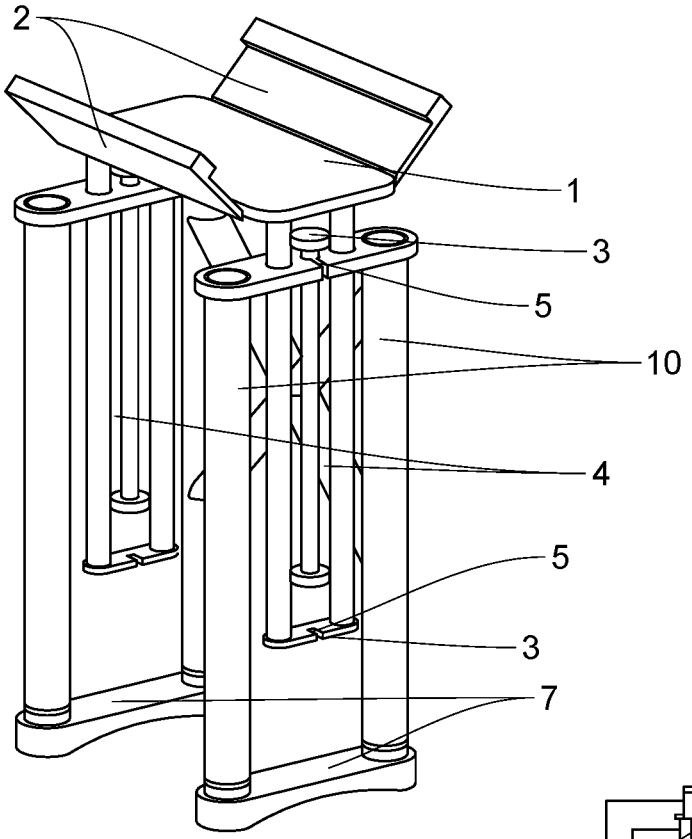
FIG. 10 is an isometric view of the entire system of the present invention, assembled, at its contracted position.

The end points of each of the elastic bands 4 have elastic band end caps 3 that are notched and wider than the elastic bands 4 themselves. These elastic band end caps 3 allow the ends of the said elastic bands to stay affixed onto the said elastic band insertion slots 5, so when the user retracts the device of the present invention, at the user's full standing position, the elastic bands 4 expand, exerting pressure and resistance upon a user as the user motions from a squatting position to a full stance position, and the shoulder harnesses 7 are positioned and affixed onto the bottom of the rectangular-shaped frames 10, as showing in FIG. 10. In some instances, the elastic bands 4 may be affixed to each of the of the frames 9 and 10 by other methods (not shown) such as, but not limited to, tying the ends of the elastic bands 4 up and around the proximity of where the elastic band insertion slots are One or more frame stabilization bars 6 are mounted on and in between the two rectangular-shaped frames 10, as shown in FIG. 6, for example. The frame stabilization bars 6 are designed to assist the user to have a more uniform squatting motion, which allows the device of the present invention to exert consistent pressure and resistance upon each of the user's shoulders.

Figure 12:
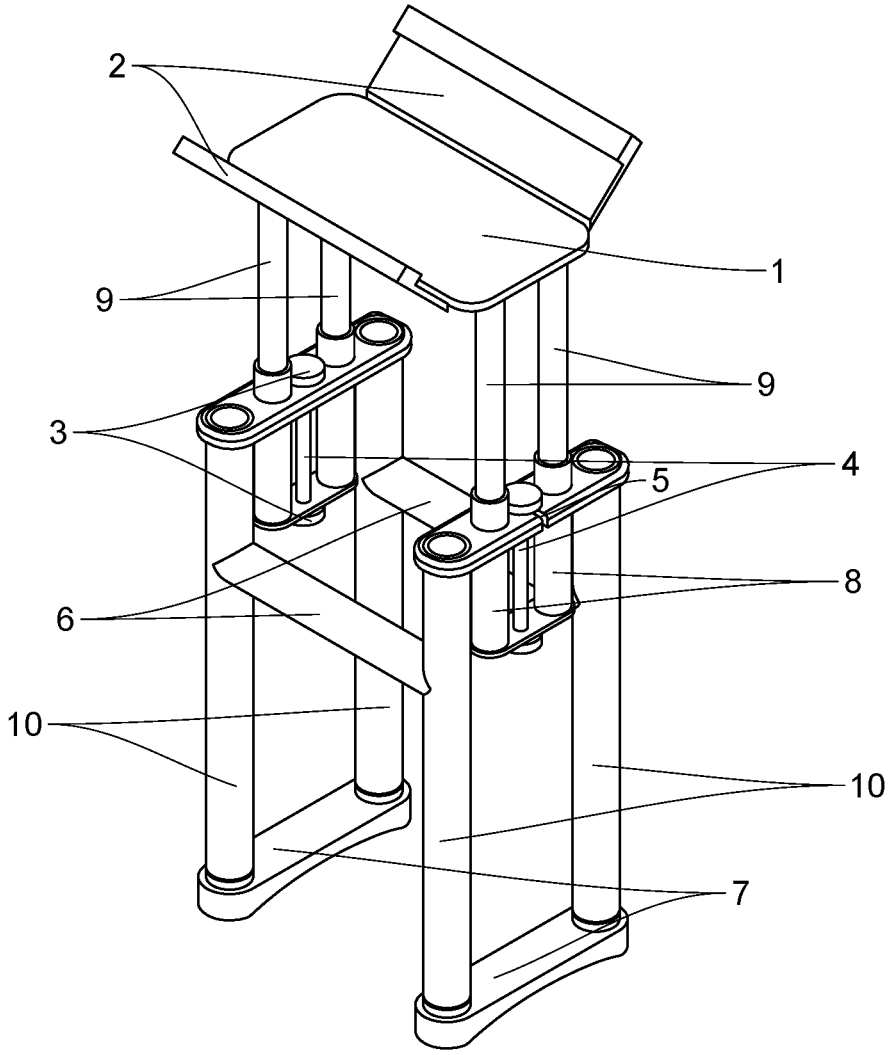
FIG. 12 is an alternate embodiment of the present invention, having different structured frame stabilization bars and motion alignment stabilizers, which are configured to assist the rectangular-shaped frame to glide at a more consistent vertical trajectory, as the user squats up and down while performing its exercises.
Figure 13:
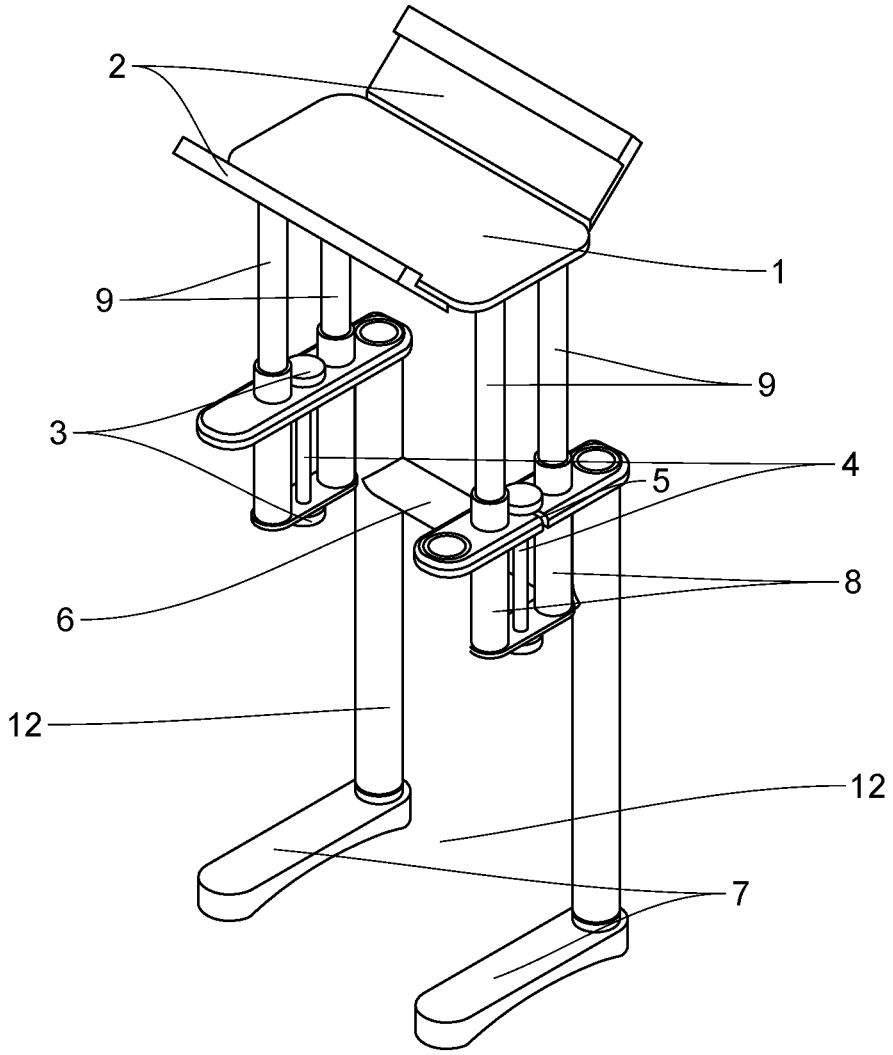
FIG. 13 is another embodiment of the present invention, illustrating a device with the rectangular-shaped frame being substituted for a c-shaped frame.
Figure 14:
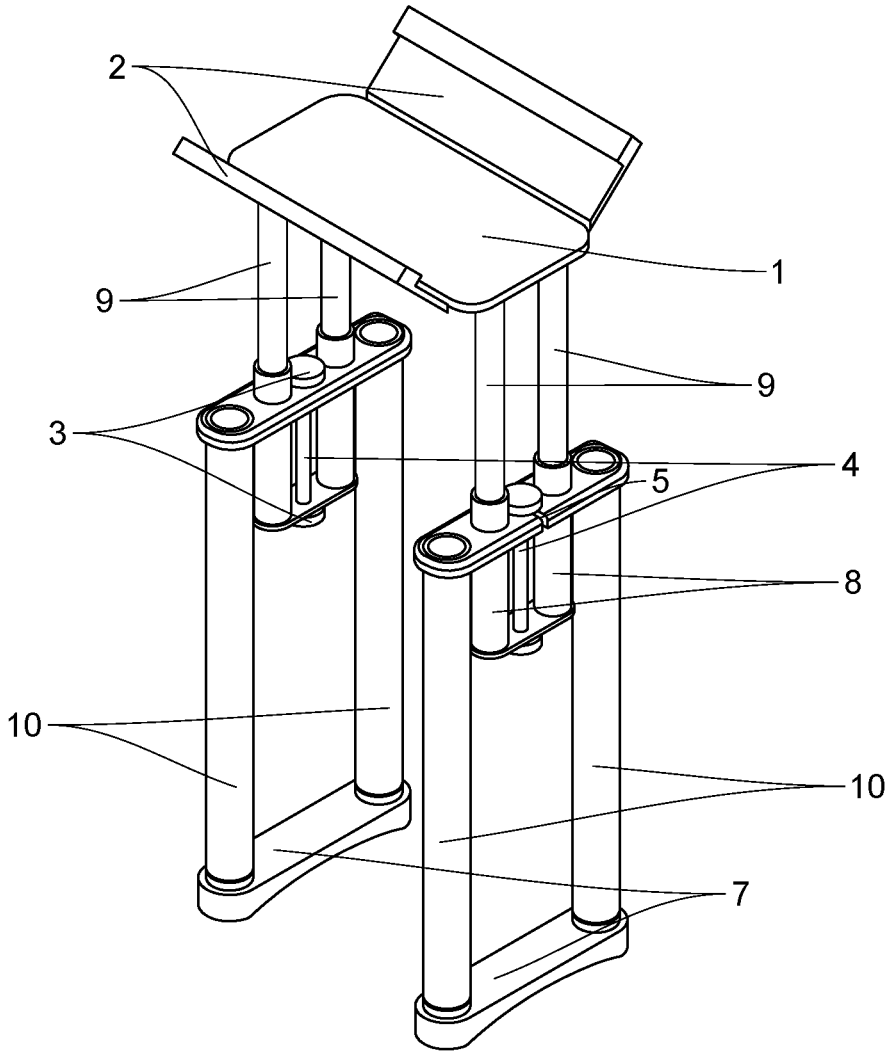
FIG. 14 is another embodiment of the present inventions, illustrating a device without the stabilization bars of the rectangular shaped frames.

According to another alternative embodiment of the present invention, the u-shaped frames 9 do not necessarily need to be u-shaped but could be of any other suitable shape. Likewise, the rectangular-shaped frames 10 do not necessarily need to be rectangular-shaped but can be of any other suitable shape such as a c-shaped frame 12, as shown in FIG. 13, for example. In some instances, the frame stabilization bars 6 can be absent, as shown in FIG. 14. In some instances, the frame stabilization bars 6 do not need to be structured in an "x" shaped configuration but can be positioned parallel to each other, for example horizontally, in between the rectangular-shaped frames 10, as shown in FIG. 12. According to some embodiments of the present invention, the u-shaped frames 9 can further comprise each one or more motion alignment stabilizers 8, as shown in FIGS. 12-13.

It will be appreciated by a person skilled in the art, that the length of any of the said u-shaped frames 9 and rectangular-shaped frames 10 can be designed to have any length suitable to accommodate people of different heights. Additionally, the frames 9 and 10 may also be equipped with any mechanism to allow for the user to adjust the length or any given mechanical configuration that enables these frames to be automatically adjusted in length. The frames 9 and 10 can be tubular in shape, as shown in FIGS. 3-6, for example, but they also can be of any other suitable shape, such as square, oval or the like.

The number of elastic bands 4 that are inserted into the corresponding elastic band insertion slots 5 can range from zero to ten, and in some instances, to more than ten, wherein inserting more elastic bands provides more resistance and pressure upon the user as the user performs exercises. In some instances, the bands can be formed by twisting together two or more bands. The exercise apparatus of the present invention can be outfitted with a horizontal bar (not shown), in place of the shoulder harnesses 7, the said substituted horizontal bar can simulate a bar bell, used in a traditional squat rack.

When the device of the present invention is fully assembled, the user clamps the present invention onto the top of a doorframe as shown in FIG. 11, for example. Thereafter, the user positions his or her shoulders under the shoulder harnesses 7, and then proceeds to perform squat exercises. The user also has the option of not performing squat exercises but instead performing motions from standing flat-footed to the tippy-toe standing position, thereby working out the calf muscles.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements.

The foregoing detailed description is merely exemplary in nature and is not intended to limit the invention or application and uses of the invention. Furthermore, there is no intention to be bound by any expressed or implied theory presented in the preceding technical field, background, brief summary, or the following detailed description.

What is claimed is:

1. A doorway workout system comprising:

a pair of first frame members each having two frame insertion openings within a horizontal top member of said first frame members and a horizontal bottom member configured to engage shoulders of a user;

the horizontal top and bottom members being connected by at least one vertical member;

a pair of second frame members slidably received through the frame insertion openings of the horizontal top member of said first frame members and having a bottom member;

a base configured to mount the system to a doorway;

wherein the base is coupled to the second frame members; and one or more elastic bands having a pair of end caps;

wherein the horizontal top members of said first frame members each further comprising one elastic band insertion slot and the bottom members of said second frame members each further comprising one elastic band insertion slot, for coupling one or more elastic bands to the frame members such that when the user engages the bottom members of the first frame member, the one or more elastic bands expand to exert pressure and resistance.

2. A doorway system according to claim 1, further comprising one or more frame stabilization bars coupled to the pair of first frame members.

3. A doorway system according to claim 2, wherein two frame stabilization bars are disposed in an x-shaped configuration.

4. A doorway system according to claim 2, wherein two frame stabilization bars are parallel to each other.

5. A doorway system according to claim 1, wherein the pair of second frame members each further comprising one or more motion alignment stabilizers.

6. A doorway system according to claim 1, wherein two the pair of first frame members are each comprised of top and bottom horizontal members and two vertical side members.

7. A doorway system according to claim 6, wherein the two vertical side members are tubular in shape.

8. A doorway system according to claim 6, wherein the bottom horizontal members are shoulder harnesses.

9. A doorway system according to claim 6, wherein the elastic band insertion slots and the frame insertion openings are disposed in the horizontal top members of said pair of first frame members.

10. A doorway system according to claim 1, wherein the pair of second frame members are each comprised of two vertical side members and one bottom member.

11. A doorway system according to claim 1, wherein the pair of first frame members are each comprised of a vertical member coupled to top and bottom horizontal members.

12. A doorway system according to claim 11, wherein either the bottom horizontal members or vertical members are further connected to each other by a horizontal tubular bar.

13. A doorway system according to claim 11, wherein the vertical members are tubular in shape.

14. A doorway system according to claim 1, wherein the pair of second frame members and first frame members are coupled to each other by one or more springs.

15. A doorway system according to claim 1, wherein the base configured to mount the system to a doorway is permanently coupled to the second frame members.

16. A doorway system according to claim 1, wherein the base configured to mount the system to a doorway is detachably coupled to the second frame members.

17. A doorway system according to claim 1, wherein the pair of first frame members are further coupled to each other by a horizontal bar.

18. A doorway system according to claim 1, wherein the base configured to mount the system to a doorway further comprising a pair of doorway clam arms.

* * * * *